US005423968A

United States Patent [19]

Kissane

[11] Patent Number: 5,423,968

[45] Date of Patent: Jun. 13, 1995

[54] ALUMINA SUPPLY APPARATUS FOR ELECTROLYTIC SMELTER

[75] Inventor: James P. Kissane, Portland, Australia

[73] Assignee: Portland Smelter Services Pty. Ltd., Melbourne, Australia

[21] Appl. No.: 244,896

[22] PCT Filed: Jul. 8, 1993

[86] PCT No.: PCT/AU93/00332

§ 371 Date: Jun. 21, 1994

§ 102(e) Date: Jun. 21, 1994

[87] PCT Pub. No.: WO94/01601

PCT Pub. Date: Jan. 20, 1994

[30] Foreign Application Priority Data

Jul. 14, 1992 [AU] Australia ..... PL3496

[51] Int. Cl.[6] ..... C25C 3/14

[52] U.S. Cl. ..... 204/245; 204/279

[58] Field of Search ..... 204/245, 279

[56] References Cited

U.S. PATENT DOCUMENTS

| | | | |
|---|---|---|---|
| 3,371,026 | 2/1968 | Kiley et al. | 204/245 |
| 3,901,787 | 8/1975 | Niizcki et al. | 204/245 |
| 4,049,529 | 9/1977 | Golla | 204/246 |
| 4,321,115 | 3/1982 | Rebmann et al. | 204/67 |
| 4,328,085 | 5/1982 | Friedli et al. | 204/245 |
| 4,431,491 | 2/1984 | Bonny et al. | 204/67 |
| 4,437,964 | 3/1984 | Gerphagnon et al. | 204/245 |
| 4,563,255 | 1/1986 | Heinzmann et al. | 204/245 X |
| 5,045,168 | 9/1991 | Dalen et al. | 204/245 |

FOREIGN PATENT DOCUMENTS

92/06230 4/1992 WIPO .

OTHER PUBLICATIONS

Metallurgy, SU 1560-636-A, p. 23, Apr. 1990.
Metallurgy, SU 985-154-A, p. 18 Dec. 1982.

*Primary Examiner*—Donald R. Valentine

[57] ABSTRACT

A feeder assembly for an alumina electrolysis cell includes an alumina dose holder (5) defined between inner and outer walls (6, 7, 7') with an inlet port in the outer wall above an outlet port in the inner wall. The inlet and outlet ports (8, 11) are closable and openable by valve means formed by relative movement between the outer wall (7, 7') and a valve seat (10, 12) cooperating with a seating edge of the outer wall (7, 7'). The valve means is moved by drive means (13) including a pneumatically operated piston (14) movable within a cylinder (15) concentric with the shaft (2) of an electrolyte crust-breaking plunger (1). The plunger shaft (2) is axially slidable within an annular sleeve (18) of the piston (14) which is connected to at least one movable component of the valve means.

8 Claims, 2 Drawing Sheets

ALUMINA SUPPLY APPARATUS FOR ELECTROLYTIC SMELTER

This invention relates to apparatus for the controlled supply of alumina or other solid materials to an electrolytic cell in which the alumina is converted to aluminum.

In the electrolysis of alumina, solid alumina is dissolved in a tank or pot containing molten electrolyte such as cryolite and it is desirable to maintain the alumina concentration in the electrolyte within a predetermined range. In current practice for the electrolysis of alumina, the alumina is fed in successive doses of predetermined size into one or more holes which are made in the electrolyte crust so that the alumina can be admitted when required. As the electrolysis of the alumina proceeds continuously, it would be desirable if the alumina consumed in the electrolysis process could be continuously replaced so as to maintain the optimum alumina concentration in the electrolyte. However, the optimum operating conditions are such that the electrolyte crust continuously reforms on the surface of the electrolyte, making it difficult to supply alumina continuously to the molten electrolyte beneath the crust.

For this reason, known alumina feeding procedures involve the use of a crust breaker which is operated intermittently to break the electrolyte crust and form a hole through which the solid alumina can be fed. However, the action of the crust breaker is necessarily such that the crust breaking mechanism, such as a pneumatically operated shaft with an appropriate chisel means (hereinafter referred to as a plunger) at its free end, will be moved in and out of the hole formed by the plunger.

In one known feeding procedure, a single pneumatic mechanism is used to operate the crust breaking mechanism, and the discharge of alumina from a storage device is co-ordinated with the downward movement of the crust breaker. In this procedure, the alumina charge is thus released when the crust breaker is through the crust so that the alumina is not free to enter the hole in the crust until the crust breaker is retracted. While this procedure has the advantage of a single pneumatic system, it is obvious that not all the alumina will be able to pass through the hole into the electrolyte immediately when the crust breaker is retracted.

It will also be apparent that with this form of mechanism, the plunger must travel through the crust each time a charge of alumina is to be introduced into the electrolyte. This not only involves use of sufficient air to drive the plunger but also may involve dipping the plunger into the electrolyte with each stroke. It is desirable to reduce the number of times the plunger contacts the electrolyte as far as possible so that wear of the plunger can also be reduced.

Accurate alumina flow control is made difficult by the required relationship between the plunger movement and movement of the flow control valve controlling alumina discharge. It will be understood that the force available and speed necessary for plunger movement must be sufficient to achieve crust breakage. This force, speed and the amount of air needed to produce them are far greater than that needed to move the alumina flow control valve and it is therefore necessary to cushion the final stages of the pneumatic mechanism against the considerable force available for plunger movement. Because of the interaction between the pneumatic mechanism and the control valve, this necessary cushioning action affects addition accuracy.

In another procedure, two separate pneumatic systems are employed, one operating the crust breaking mechanism and the other operating the alumina feeding system. In this procedure, it is possible for the mechanism operating the crust breaking mechanism to form the necessary hole in the electrolyte crust and retract the crust breaker so that the feeding system can then be operated to place a charge of alumina into the hole formed by the crust breaker. There is less air usage as the dosing cylinder of the alumina feeding system is of smaller capacity and may operate more often than the crust breaker as it is independent of the crust breaker mechanism. However, this known procedure requires separate housings for the crust breaking mechanism and the alumina feeding system. These separate housings not only reduce the space available for operating above the electrolysis tank but also complicate the construction of the whole assembly. Hence this design is more expensive than the single pneumatic mechanism design.

In our prior Australian patent application no. PK 2658/90 (which forms the basis for International Application PCT/AU91/00169) we proposed a feeder assembly in which a valve mechanism concentric with the shaft of the crust breaking plunger is operable in response to the initial part only of the downward movement of the plunger but achieves the advantage of having the plunger out of the alumina flow. However, like the first design, it is affected by cushioning, as the crust breaker cylinder is much larger than necessary for dosing of the alumina. This design is still affected by high air usage but its accuracy of dosing is less affected by speed.

It is therefore an object of the present invention to provide an improved alumina feeder assembly which enables direct feed of alumina into the hole (as is the case with the two separate pneumatic systems design and our Australian patent application PK 2658/90) and significant reduction in air usage compared to a design using a single pneumatic drive cylinder.

Accordingly, the present invention provides a feeder assembly for an alumina electrolysis tank including a crust breaking mechanism operable to break a hole in crust formed on the surface of molten electrolyte, the crust breaking mechanism including a plunger with a cutting edge mounted on a reciprocable plunger shaft, and an alumina storage container adapted to release alumina as required into a dose holder, characterised in that the dose holder is defined between inner and outer walls, an inlet port is formed in the outer wall above an outlet in the inner wall whereby alumina can flow through the dose holder from inlet port to outlet port under the influence of gravity, the inlet and outlet ports being closable and openable by valve means formed by relative movement between the outer wall of the dose holder and a valve seat which cooperates with a sealing edge of the outer wall, the valve means being movable by drive means including a pneumatically operated piston movable within a cylinder concentric with the plunger shaft, the piston having an annular sleeve axially slidable within the cylinder and the plunger shaft being axially slidable within the sleeve which is connected to an extension sleeve in turn connected to at least one movable component of the valve means.

The feeder assembly of the present invention includes a crust breaking mechanism which is preferably pneumatically operated. The crust breaking mechanism includes a plunger with a cutting edge for breaking the crust, mounted on a reciprocable plunger shaft.

The feeder assembly may be associated in use with at least one storage container comprising a hopper or similar vessel for finally divided alumina. Other storage containers for other additives to the electrolysis tank, such as aluminium fluoride, calcium fluoride, crushed bath, soda ash, or cryolite may be associated with similar feeder assemblies. The other storage containers may thus be adapted to feed their contents into the tank in a similar manner to that described below for the alumina.

The storage container or containers are adapted to feed their contents as required into a dose holder. Preferably the storage container contents are first fed into a supply chamber which has an exit port communicating with an inlet port of the dose holder. The dose holder is defined between inner and outer walls which are preferably concentric with each other and with the plunger shaft. The inlet port of the dose holder is formed in its outer wall. The dose holder further includes an outlet port located below the inlet port so that alumina or other material can flow through the dose holder from inlet port to outlet port under the influence of gravity.

Both the inlet port and the outlet port are closable and openable by valve means formed by relative movement between the outer wall of the dose holder and a valve seat which co-operates with a seating edge of the outer wall. Preferably the inlet port is closed by a movable upper wall seatable in a fixed upper seat and the outlet port is closed by movement of a movable lower seat into abutment with a fixed lower wall.

In accordance with the invention, we provide for movement of the valve means by a drive means including a pneumatically operated piston movable within a cylinder concentric with the plunger shaft. This piston includes an annular sleeve axially slidable within the cylinder and the plunger shaft is axially slidable within the sleeve. The piston sleeve is connected to a preferably annular extension sleeve which is in turn connected to at least one movable component of the valve means.

In one preferred construction, the drive means is connected to move the upper wall of the dose holder and the movable lower seat simultaneously. Thus the outlet port is closed as the inlet port is opened. Conversely, the inlet port is closed as the outlet port is opened.

Alternatively, the construction may provide for independent operation of the inlet port valve means and of the outlet port valve means. For example, the piston may be connected to move the inner wall and the valve seat associated with the outlet port of the dose holder, and the outer wall of the dose holder is connected to the cylinder wall which is movable concentrically with the piston. The movable cylinder and outer wall control the operation of the valve means associated with the inlet port.

Whatever particular construction is used, the use of the plunger shaft concentrically slidable within the piston provides valve means operable independently of the plunger. Accordingly, the valve means can be operated as often as required to add alumina to the electrolysis tank while the plunger needs to be operated only when necessary to break the crust and allow access of the alumina to the electrolyte mix. The cylinder driving the valve means needs only to be of considerably smaller stroke than that driving the crust breaker. The cylinder driving the valve means can also be of smaller piston area. There are thus made possible significant savings in air usage compared with a single pneumatic mechanism.

The apparatus of the invention preferably includes a housing which surrounds the plunger shaft and the generally concentric feed mechanism components described above. The lower end portion of the housing preferably tapers inwardly to facilitate direction of the alumina falling towards the electrolysis tank after leaving the outlet port of the feeder assembly. The lower edge of the housing thus defines the periphery of a release port through which alumina leaves the housing as it falls towards the tank.

Alternatively, the lower end portion of the housing may be formed to provide two or more downwardly tapering outlets directed towards the hole formed in the electrolyte crust by the plunger.

To assist a further understanding of the invention, reference is now made to the accompanying drawings which illustrate one preferred embodiment of the present invention. It is to be appreciated that this embodiment is given by way of illustration only and that the invention is not to be limited by it.

BRIEF DESCRIPTION OF DRAWINGS

The drawings show, somewhat diagrammatically, sectional views of a preferred form of feeder assembly.

DESCRIPTION OF PREFERRED EMBODIMENT

Figure 1:
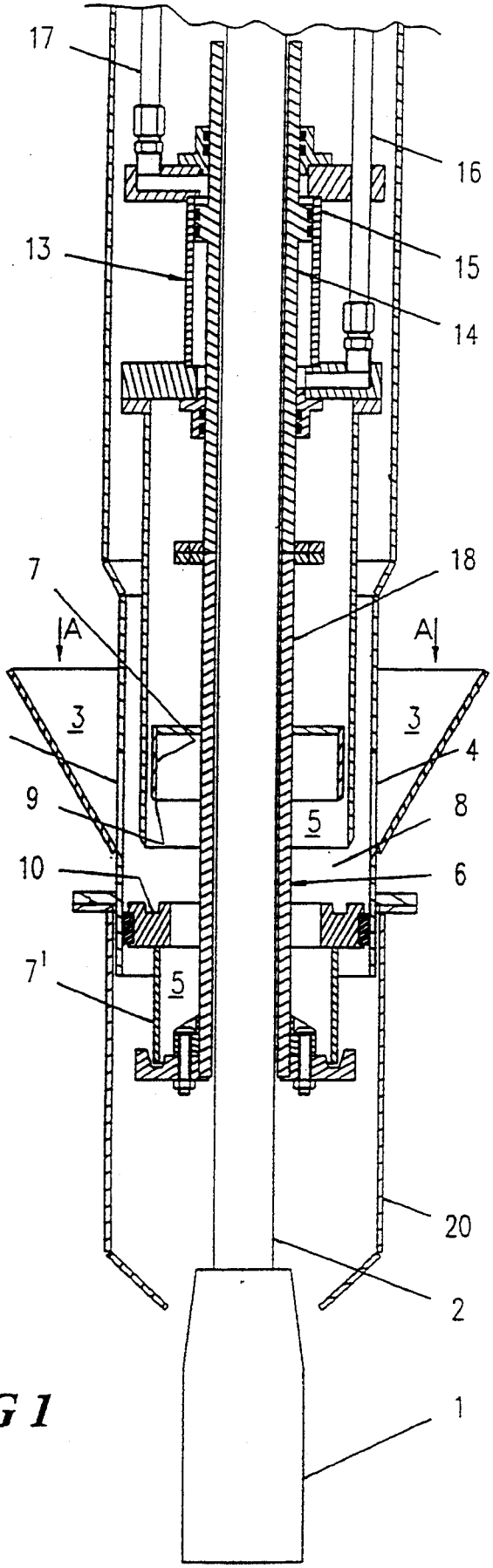
In FIG. 1, the dose holder is open to the entry of alumina.
Figure 2:
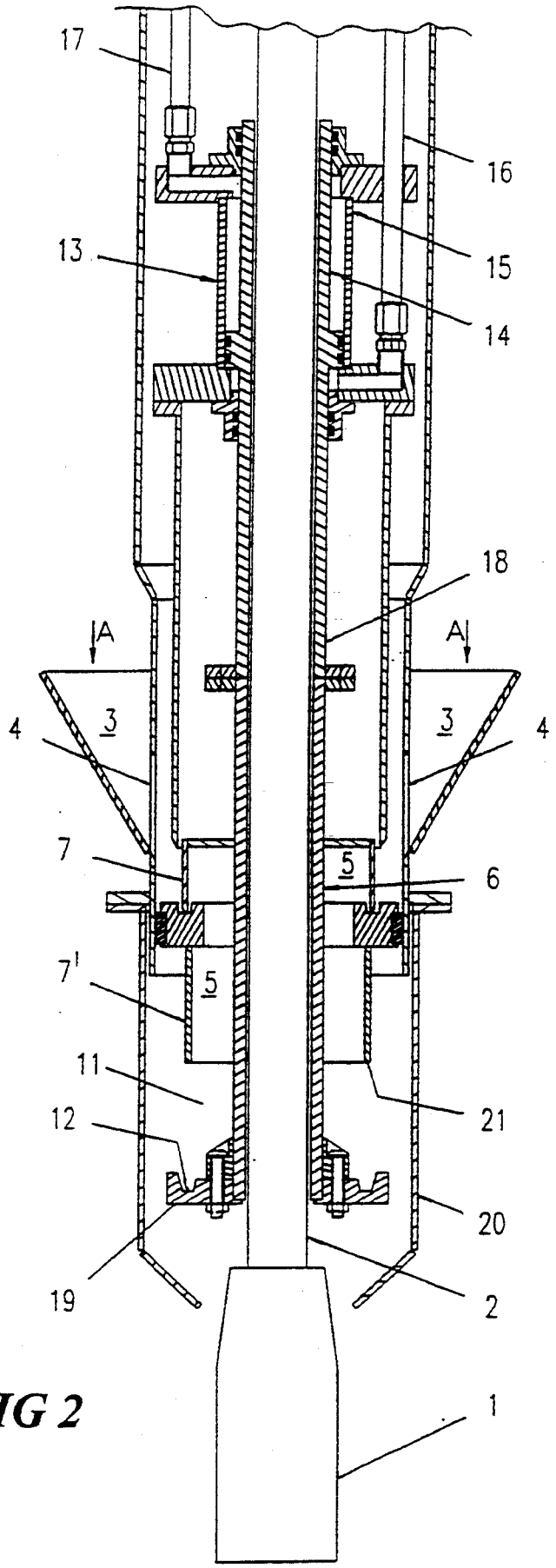
FIG. 2 shows the dose holder at the opposite extreme of the valve movement, closed to the entry of alumina but open to discharge alumina.

In the drawings, a crust breaking plunger 1 is carried by plunger shaft 2. A storage container (not shown) feeds alumina or other tank additive as indicated by arrows A into an annular supply chamber 3. Supply chamber 3 has an exit port or ports 4 which remain open allowing the alumina to fall towards annular dose holder 5. Dose holder 5 is defined between an inner wall 6 and an outer wall 7, 7', both of which are concentric with plunger shaft 2.

The outer wall of the dose holder is formed in two parts, 7 and 7'. In the illustrated embodiment, the upper part 7 of the outer wall is movable and in its raised position provides an inlet port 8 to the dose holder 5 between its lower seating edge 9 and valve seat 10. The movement of outer wall part 7 and its association with valve seat 10 thus provide a valve means for inlet port 8.

A valve means for outlet port 11 of the dose holder is provided by the relative movement between movable valve seat 12 and the fixed lower wall part 7' of the dose holder outer wall.

Movement of the respective valve means is controlled by drive means 13 which includes a pneumatically operated piston 14 movable within cylinder 15. Air supply lines 16 and 17 are used to activate the upward and downward movement of piston 14 within cylinder 15. The lower end of piston 14 is connected to extension sleeve 18 which in turn carries the upper part 7 of the dose holder outer wall and the lower wall 19 of the dose holder which includes movable valve seat 12.

As will be appreciated, downward movement of piston 14 from the position shown in FIG. 1 brings the sealing edge 9 of part wall 7 into contact with valve seat 10, thus closing dose holder inlet port 8. At the same time the downward movement of piston 14 separates movable valve seat 12 from the lower edge 21 of dose holder part wall 7', opening outlet port 11 of dose holder 5 and allowing the alumina within the dose holder to flow out under the influence of gravity. This downwardly flowing alumina is directed by the inwardly tapering lower part of housing 20 towards the plunger and plunger shaft and thus towards the hole in the crust which has been broken by the plunger.

As drive means 13 for the valve means of dose holder 5 is operable independently of the drive means (not shown) for plunger 1, the valve means can be subject to finer control than that achievable if the plunger movement and dose holder valve means movement are interdependent and is of smaller area and stroke to the crust breaker and hence saves air usage.

It is a further advantage of the present invention that the mechanism can be fitted relatively easily into existing plants which use a single pneumatic drive cylinder, when replacement of the original drive and alumina delivery mechanism is considered necessary or desirable. This can lead to savings in space and in costs associated with the structure required to support the feeder assembly. Costs can also be reduced by the use of this invention to reduce the number of plunger movements and plunger wear. The addition of alumina independently of plunger movement also allows the possibility of more frequent alumina additions, approaching continuous addition of alumina. The ability to operate the respective valve means of the inlet and outlet of the dose holder independently further allows greater accuracy of the alumina additions by preventing alumina from entering the dose holder as the dose holder contents are released.

I claim:

1. A feeder assembly for an alumina electrolysis cell including a crust breaking mechanism operable to break a hole in crust formed on the surface of molten electrolyte, the crust breaking mechanism including a plunger with a cutting edge mounted on a reciprocable plunger shaft, and an alumina storage container adapted to release alumina as required into a dose holder, characterised in that the dose holder is defined between inner and outer walls, an inlet port is formed in the outer wall above an outlet in the inner wall whereby alumina can flow through the dose holder from inlet port to outlet port under the influence of gravity, the inlet and outlet ports being closable and openable by valve means formed by relative movement between the outer wall of the dose holder and a valve seat which cooperates with a sealing edge of the outer wall, the valve means being movable by drive means including a pneumatically operated piston movable within a cylinder concentric with the plunger shaft, the piston having an annular sleeve axially slidable within the cylinder and the plunger shaft being axially slidable within the sleeve which is connected to an extension sleeve in turn connected to at least one movable component of the valve means.

2. A feeder assembly as claimed in claim 1, characterised in that the inner and outer walls of the dose holder are concentric with each other and with the plunger shaft.

3. A feeder assembly as claimed in claim 1 characterised in that the inlet port is closed by a movable upper wall seatable in a fixed upper seat and the outlet port is closed by movement of a movable lower seat into abutment with a fixed lower wall.

4. A feeder assembly as claimed in claim 3 characterised in that the drive means is connected to move the upper wall of the dose holder and the movable lower seat simultaneously.

5. A feeder assembly as claimed in claim 3 characterised in that the drive means is connected for independent movement of the respective inlet port valve means and outlet port valve means.

6. A feeder assembly as claimed in claim 5 characterised in that the piston is connected to move the inner wall and the valve seat associated with the outlet port and the outer wall of the dose holder is connected to the cylinder wall which is movable concentrically with the piston to control the operation of the valve means associated with the inlet port.

7. A feeder assembly as claim in claim 1 characterised in that the dose holder is concentric with the plunger shaft and a housing surrounds the plunger shaft and dose holder, the lower end portion of the housing tapering inwardly with its lower edge defining the periphery of a release port though which alumina leaves the housing and falls towards the tank.

8. A feeder assembly as claimed in claim 1 characterised in that the dose holder is concentric with the plunger shaft and a housing surrounds the plunger shaft and dose holder, the lower end portion of the housing being formed to provide two or more downwardly tapering outlets directed towards the hole formed in the electrolyte crust by the plunger.

* * * * *

UNITED STATES PATENT AND TRADEMARK OFFICE

CERTIFICATE OF CORRECTION

PATENT NO. : 5,423,968
DATED : June 13, 1995
INVENTOR(S) : James Patrick KISSANE It is certified that error(s) appears in the above-identified patent and that said Letters Patent is hereby corrected as shown below:

On the title page:

Between Lines 6 and 7, insert --BACKGROUND OF THE INVENTION--;

Line 32, change "such as" to --for example,--.

Column 2:

Line 22, delete "our prior";

Line 24, change "we proposed" to --,--;

after "assembly" insert --was proposed--;

Between line 34, and 35, insert --SUMMARY OF THE INVENTION--;

Line 39, change "our Australian patent application PK 2658/90" to

--Australian Patent Application PK 2658/90--.

Column 4:

Between Lines 24 and 25, insert --BRIEF DESCRIPTION OF THE DRAWINGS--;

Between Lines 33, and 34, INSERT --DETAILED DESCRIPTION OF THE INVENTION--;

Line 34, change "In the drawings, a" to --A--.

UNITED STATES PATENT AND TRADEMARK OFFICE

CERTIFICATE OF CORRECTION

PATENT NO. : 5,423,968 
DATED : June 13, 1995
INVENTOR(S) : James Patrick KISSANE It is certified that error(s) appears in the above-identified patent and that said Letters Patent is hereby corrected as shown below:

Column 5:

Claim 1, line 10, after "defined" insert --relative to the plunger shaft--;

line 11, delete "is formed in" and insert --and an outlet port of the dose holder being formed at--;

line 12, after "wall" insert --with the inlet port being located--;

line 12, delete "an" and insert --the-- line 12, delete "in the inner wall" and insert --port--;

line 13, insert --the-- after "from"

line 14, insert --the-- after "to";

line 17, delete "a" and insert --at least one--.

Column 6:

Claim 2, line 1, delete "A" and insert --The--.

Claim 3, line 1, delete "A" and insert --The--;

line 1, insert --,-- after "1";

line 5, insert --portion of the outer-- after "lower".

Claim 4, line 1, delete "A" and insert --The--' line 1, insert --,-- after "3";

line 3, insert --portion of the outer-- after "upper".

UNITED STATES PATENT AND TRADEMARK OFFICE

CERTIFICATE OF CORRECTION

PATENT NO. : 5,423,968
DATED : June 13, 1995
INVENTOR(S) : James Patrick KISSANE It is certified that error(s) appears in the above-identified patent and that said Letters Patent is hereby corrected as shown below:

Column 6:

Claim 5, line 1, delete "A" and insert --The--;

line 1, insert --,-- after "3";

Claim 6, line 1, delete "A" and insert --The--;

line 1, insert --,-- and after "5";

line 4, insert --upper portion of the-- before "outer".

Claim 7, line 1, delete "A" and insert --The--;

line 1, delete "claimed" after "as" and insert --claimed--;

line 1, insert --,-- after "claim 1";

line 6, delete "though" and insert --through--;

line 7, delete "tank" and insert --hole--.

Claim 8, line 1, delete "A" and insert --The--;

line 1, insert --,-- after "1".

Signed and Sealed this

Twenty-eighth Day of November 1995

*Attest:*

Bruce Lehman

BRUCE LEHMAN

*Attesting Officer*

*Commissioner of Patents and Trademarks*